US005427634A

United States Patent [19]

Fujita et al.

[11] Patent Number: 5,427,634

[45] Date of Patent: Jun. 27, 1995

[54] FERRITE SYSTEM STAINLESS STEEL HAVING EXCELLENT NACL-INDUCED HOT CORROSION RESISTANCE AND HIGH TEMPERATURE STRENGTH

[75] Inventors: Nobuhiro Fujita, Futtsu; Keiichi Ohmura, Kitakyusyu; Eiji Sato, Futtsu, all of Japan

[73] Assignee: Nippon Steel Corporation, Tokyo, Japan

[21] Appl. No.: 162,054

[22] PCT Filed: Apr. 9, 1993

[86] PCT No.: PCT/JP93/00453

§ 371 Date: Dec. 8, 1993

§ 102(e) Date: Dec. 8, 1993

[87] PCT Pub. No.: WO93/21356

PCT Pub. Date: Oct. 28, 1993

[30] Foreign Application Priority Data

Apr. 9, 1992 [JP] Japan ..... 4-089121
Oct. 8, 1992 [JP] Japan ..... 4-270102
Dec. 28, 1992 [JP] Japan ..... 4-349484

[51] Int. Cl.[6] ..... C22C 38/26; C22C 38/28

[52] U.S. Cl. ..... 148/325; 420/68; 420/69

[58] Field of Search ..... 148/325; 420/68, 69

[56] References Cited

U.S. PATENT DOCUMENTS 4,286,986 9/1981 Borneman .

FOREIGN PATENT DOCUMENTS 0024124 2/1981 European Pat. Off. .
53-99024 8/1978 Japan ..... 148/325
54-126620 10/1979 Japan ..... 148/325
1-8254 1/1989 Japan .
1-41694 9/1989 Japan .
0391054 10/1990 Japan .
3-264652 11/1991 Japan .
3-274245 12/1991 Japan .
4-74852 3/1992 Japan .

OTHER PUBLICATIONS

"Localized Corrosion Resistance of High Alloy Austenitic Stainless Steels and Welds", N. Suutala, et al., Stainless Steel '84, Gotebrog, Sweden, pp. 240–247.

*Primary Examiner*—Deborah Yee
*Attorney, Agent, or Firm*—Kenyon & Kenyon

[57] ABSTRACT

To simultaneously satisfy retention of a high temperature strength at an initial stage, and during use, and NaCl-induced hot corrosion resistance as well as oxidation resistance in a high temperature member used in an exhaust system of automobiles, the present invention provides a heat-resistant ferrite system stainless steel which has a low (C+N) content, reduces a free (C+N) content by adding Ti or Zr, and can secure sufficiently efficiently solid solution strengthening and NaCl-induced hot corrosion resistance for a long time by sufficiently securing solid solution contents of W, Nb and Mo.

7 Claims, 10 Drawing Sheets

| EXAMPLE OF COMPONENT | Sℓ:0.1/0.5 | Sℓ >0.5 |
|---|---|---|
| WITHOUT Mo AND W | △ | ▲ |
| Mo ALONE | ○ | ● |
| W ALONE | □ | ■ |
| Mo AND W COMPOSITE | ◇ | ◆ |

| EXAMPLE OF COMPONENT | Sℓ:0.1/0.5 | Sℓ >0.5 |
|---|---|---|
| WITHOUT Mo AND W | △ | ▲ |
| Mo ALONE | ○ | ● |

| EXAMPLE OF COMPONENT | Sε:0.1/0.5 | Sε >0.5 |
|---|---|---|
| WITHOUT Mo AND W | △ | ▲ |
| Mo ALONE | ○ | ● |
| W ALONE | □ | ■ |
| Mo AND W COMPOSITION | ◇ | ◆ |

FERRITE SYSTEM STAINLESS STEEL HAVING EXCELLENT NACL-INDUCED HOT CORROSION RESISTANCE AND HIGH TEMPERATURE STRENGTH

TECHNICAL FIELD

This invention relates to a ferrite system stainless steel which is used as a high temperature member of an exhaust pipe and a catalyst outer cylinder of automobiles, an exhaust duct of a power generation plant, etc, has an excellent high temperature strength and is particularly excellent in a NaCl-induced hot corrosion resistance.

BACKGROUND ART

Improvements in fuel-to-cost performance and power output of automobiles have been desired in recent years, and a reduction in the weight of automobile materials has been strongly desired. Also, to strengthen a regulation of pollution, purification of an exhaust gas has also been strongly desired. With such a background, as exhaust system materials for automobiles, SUS430LX and AISI409, as existing ferrite system stainless steels, have been used to reduce the weight of exhaust system materials for automobiles and to accomplish a lower thermal capacity of the components. With the improvement in fuel-to-cost performance and a higher output, the highest temperature of the exhaust gas now reaches about 900° C., and the temperature is about 900° C. in the vicinity of an exhaust manifold and about 600° C. in the vicinity of a front pipe. For these reasons, heat-resistant materials used for these thin sheet structures must satisfy the following material properties:

(1) The materials have a high high-temperature strength and high-temperature strength during use.

(2) The materials have excellent thermal fatigue characteristics and high temperature fatigue characteristics.

(3) The materials have excellent normal temperature workability.

(4) The materials have excellent NaCl-induced hot corrosion resistance.

(5) The materials have excellent oxidation resistance.

(6) The materials form a weld bead shape which does not invite stress concentration.

It is expected that if the high temperature strength is improved and a high temperature strength during use can be secured, a high temperature fatigue as well as thermal fatigue characteristics can be improved. In other words, when the characteristics (1) are satisfied, the characteristics (2) can be accomplished, too. The structure described is welded structure made of thin sheets. Therefore, weldability and thermal fatigue characteristics at the weld portions are important. Accordingly, the item (6) is also very important.

Further, the NaCl-induced hot corrosion resistance (4) has drawn a particular attention in exhaust system components of automobiles in which the thickness of said component has been considerably reduced. When automobiles run on the road on which an antifreezing mixture (consisting primarily of salt) is scattered in the cold season, this antifreezing mixture adheres to exhaust system components of the automobile, particularly to an exhaust manifold and a front pipe, which are heated to about 600° C. by an exhaust gas. Then, the surface of these components is corroded and reduction of the thickness takes place until at last breakage of the components occurs and a critical accident is invited.

Accordingly, an improvement in the high temperature tensile strength and NaCl-induced hot corrosion resistance of the materials of the exhaust system of the automobiles due to the increase in the exhaust gas temperature has become a serious problem.

As technologies for improving the various characteristics described above, the following prior art references are known.

Japanese Unexamined Patent Publication (Kokai) Nos. 64-8254, 3-274245 and 4-74852 describe technology relating to the exhaust manifold. Japanese Unexamined Patent Publication (Kokai) No. 64-8254 discloses a composition in which at least 17% of Cr is added in order to improve the oxidation resistance, which uses Nb as an essential component and Mo as a selective element. However, this reference does not add an element (e.g. Ti.) having higher affinity with C and N than Nb and Mo. Therefore, this reference does not consider how to secure the high temperature strength during use because Nb is in a state where it is likely to form carbonitrides during use. In Japanese Unexamined Patent Publication (Kokai) No. 3-274245, the Cr content is rather high, Nb and Mo are essential and Ti is a selective element. This reference also does not consider how to secure strength during use at a high temperature, and uses Ni and Cu as the essential components.

This composition is different from that of the present invention, inclusive of Cr. In Japanese Unexamined Patent Publication (Kokai) No. 4-74852, the Cr content is lower than that in Japanese Unexamined Patent Publication (Kokai) No. 3-274245, Nb and Ti are the essential elements, Mo and Al are not added, and up to 0.5% of Si is added. This reference does not consider NaCl-induced hot corrosion resistance or oxidation resistance at a lower Cr content.

As to a muffler application, Japanese Unexamined Patent Publication (Kokai) No. 3-264652 can be cited. In the composition of this reference, the Cr content exists in a broad range of 11 to 30%, Ti and Nb are the essential elements, and Mo is a selective element. To examine a NaCl-induced corrosion resistance at a normal temperature, a salt water spray test is carried out at 35° C., and as to NaCl-induced corrosion, the reference describes that at least 18% of Cr and 1.0 to 4.0% of Mo are preferably added. The NaCl-induced corrosion at the normal temperature described in this reference is analogous to a resistance to rust (a resistance to rust growing) in the stainless steel, and it is an ordinary view that this property can be improved by adding Cr and Mo (e.g. N. Suutala et al., "Stainless Steels", '84 Gotebrog, Sweden, p. 240 (1984)). On the other hand, the term "NaCl-induced hot corrosion resistance" means the NaCl-induced corrosion resistance at high temperatures, and represents the phenomenon in which corrosion of a 100μ order proceeds in the form of the full surface corrosion having temperature dependence, unlike resistance to rust. Furthermore, as can be seen from FIG. 10 of the accompanying drawings, Cr is hardly effective against NaCl-induced hot corrosion at 700° C. Accordingly, it can be said that the NaCl-induced corrosion at the normal temperature is entirely different phenomenon from the NaCl-induced corrosion at a high temperature. In this way, Japanese Unexamined Patent Publication (Kokai) No. 3-264652 does not at all consider the NaCl-induced hot corrosion property.

As described above, all of the prior art references cited above do not at all teach or suggest how to secure the high temperature strength of the materials of the automobile exhaust system, particularly how to secure the strength during the use at the high temperature, or the improvement in the NaCl-induced hot corrosion resistance.

It is an object of the present invention to provide a heat-resistant ferrite system stainless steel which can simultaneously satisfy the material characteristics, before use, equal or superior to those of the conventional SUS430LX, at a low production cost, and which can particularly simultaneously secure the high high-temperature strength during use and NaCl-induced hot corrosion resistance.

In the material described above, the present invention is also directed to provide a heat-resistant ferrite system stainless steel which can offer the required material characteristics, i.e., oxidation resistance, workability, weld bead shape, etc.

DISCLOSURE OF THE INVENTION

To accomplish the objects described above, the present invention secures predetermined amounts (the range of the amount of eff. Nb) of the solid solution amount of each of Mo, W and Nb in a cold-rolled annealed sheet.

Studies conducted by the inventors of the present invention have revealed that improvements in the high temperature strength and the NaCl-induced hot corrosion resistance of the heat-resistant ferrite system stainless steel primarily result from the solid solution Nb, Mo and W, and that the solid solution Nb, Mo and W are effective for improving the high temperature strength, while the solid solution Mo and W are effective for improving the NaCl-induced hot corrosion resistance. The present inventors have attempted to secure the solid solution Mo, W and Nb in the cold rolled annealed sheet, and to allow these elements to be efficiently contained in the form of the solid solution. In other words, the C-N content is reduced, and these elements are fixed by adding a suitable amount of Ti or Zr, so as to reduce the solid solution C+N content. In this way, workability can be improved and at the same time, precipitation strengthening at a high temperature is attained by Ti (C, N) or Zr (C, N).

The most important role of the addition of Ti and Zr is to fix C and N by utilizing their higher affinity with C and N than Mo, W and Nb. When C and N are thus fixed, precipitations of carbonitrides of Mo, W and Nb are depressed, and then the solid solution amounts of these elements can be secured not only before use but also for a long time at the high temperature.

Accordingly, another effect can be obtained in that the addition amount of Nb can be made smaller by compositely adding Ti and Zr than when Nb alone is added, to obtain the same solid solution Nb amount. For this reason, particularly when Ti is used, the cost of the raw materials can be reduced (generally, the raw material cost of Nb per unit weight is lower than that of Ti). Accordingly, the cost is lower, the high temperature strength reinforcing function and the NaCl-induced hot corrosion resistance of the solid solution Nb, W and Mo can be exhibited effectively before use, and the effects of these elements can also be secured during use. Particularly to secure the high high-temperature strength during driving of the automobiles, that is, to secure the high temperature strength of the members during driving of the actual car, the eff. Nb amount or in other words, the minimum necessary solid solution Nb amount during the use at the high temperature for a long time, is defined.

As described in Japanese Unexamined Patent Publication (Kokai) No. 1-41694, the conventional conception of eff. Nb considers an MC type (Nb-C) as a precipitation carbide of Nb, and the balance obtained by subtracting the Nb amount used for this MC type carbide from an additional amount of Nb is the solid solution Nb amount and is regarded as eff. Nb.

This eff. Nb amount does not at all take into consideration the drop of the strength during use because (1) it defines only the solid solution Nb amount before use, and (2) it is based on the condition that when Ti is contained, a carbonitride of Ti preferentially precipitates.

However, the present invention takes the following factors into consideration.

(1) Precipitation of Nb during use (during driving of an automobile; temperatures of 600° to 900° C. is assumed) changes from the MC type to $M_6C$ type ($Fe_3Nb_3C$).

(2) When Zr and Ti are compositely added, N is fixed by Zr and Ti, and the remaining one-third of N precipitates as a nitride of Nb, and when Zr or Ti is alone added, one-half of N precipitates as the nitride.

(3) Precipitation of an intermetallic compound (Laves phase) with Fe is effective for reinforcing to a certain extent.

In other words, the present invention determines eff. Nb as an index for retaining the high temperature strength before, and during, use while taking the factors (1) to (3) described above into account. By the way, it is necessary that a tensile strength at 850° C. is at least 34 MPa and a tensile strength at 900° C. is at least 25 MPa, as the high temperature strength before use, in order to secure the high temperature fatigue characteristics and the thermal fatigue characteristics. When the high temperature strength during use is secured, the thermal fatigue characteristics as the most important requirement for the exhaust manifold materials can be drastically improved. This secures the solid solution Nb, Mo and W contents as the reinforcing factors at the high temperature for a long time, so that the drop of the strength occurring during thermal fatigue becomes more difficult to occur, and thermal fatigue life can be drastically extended.

Furthermore, the present invention aims at preventing the grain particles at the weld portions and weld influenced portions from becoming coarser by adding Ti, Zr and Nb, and improves weldability.

On the other hand, Mo, W and Nb are likely to form intermetallic compounds with Fe and when large quantity of such intermetallic compounds precipitate and these compounds become coarse, they deteriorate toughness during use and the high temperature strength. Though Mo and W are effective for improving the NaCl-induced hot corrosion resistance, they will lower this resistance when added in excess. Further, the addition of Nb, Mo and W invites problems during production such as a rise in the recrystallization temperature and a drop in the toughness of the steel sheets. The upper limits of Mo, W, Nb and eff. Nb are determined for the reasons described above.

The present invention sets the Cr content at a lower level than SUS430LX so as to reduce the cost of production. Therefore, Si and Al, whenever necessary, are added to secure the oxidation resistance to such an extent as not to deteriorate machinability and weldability. Further, Si and Al are elements which improve not only the oxidation resistance but also the NaCl-induced hot corrosion resistance. By the way, the rare earth elements are added to cope with those members for which the oxidation resistance is particularly required, within such a range as not to deteriorate hot workability.

As described above, the present invention takes the optimum addition balance of C, N, Si, Cr, Ti, Zr, Mo, W, Al and Nb into sufficient consideration so as to satisfy all the required characteristics, and simultaneously accomplishes a reduction in the cost of the raw materials.

BEST MODE FOR CARRYING OUT THE INVENTION

The inventors of the present invention have conducted various studies on NaCl-induced hot corrosion of automobile exhaust system materials using ferrite system stainless steel that has not been examined sufficiently in the past, and as a result, have clarified that Mo and W are extremely effective elements for preventing NaCl-induced hot corrosion.

Figure 1:
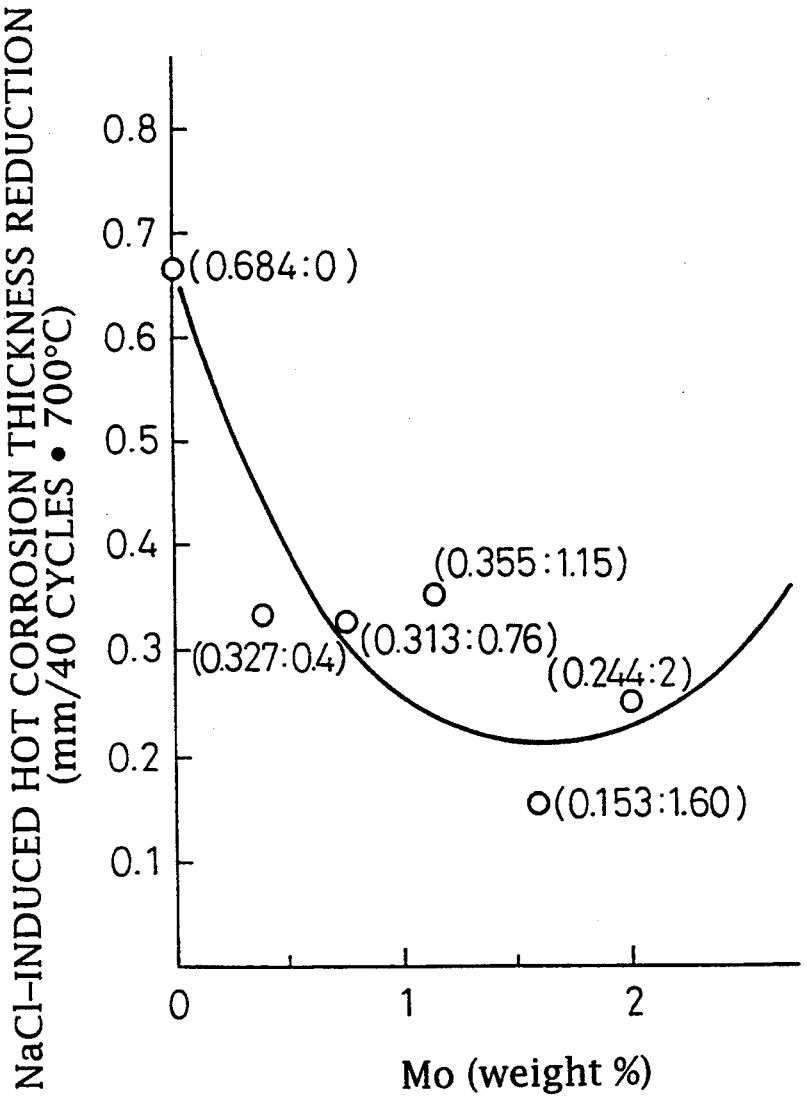
FIG. 1 is a graph showing the relationship between the Mo content and NaCl-induced hot corrosion thickness reduction in a 17Cr alloy (devoid of Si and Al).

FIG. 1 shows the relationship between an amount of addition of Mo, which is added to a 17Cr alloy not containing Si, Al, etc, (produced by vacuum fusion), and a NaCl-induced hot corrosion, that is, a NaCl-induced hot corrosion thickness reduction quantity.

The term "NaCl-induced hot corrosion thickness reduction quantity" is an index of the NaCl-induced hot corrosion and represents the reduction of thickness under a simulation of driving of an automobile on a road surface on which a freezing inhibitor is actually sprayed. It is expressed in units of mm/40 cycles.

(1) A blank material is immersed in a saturated salt water, for 5 minutes.

(2) The material is heated to 700° C. and retained at this temperature for 120 minutes.

(3) The material is cooled by air for 5 minutes.

(4) The procedures described above are repeated 40 times.

The inventors of the present invention have confirmed that the thickness reduction quantity can be limited to about a half of the case where Mo is not added, by adding 0.4 wt % of Mo as shown in FIG. 1, and to about 1/5 by adding 1.5 wt % of Mo. This characteristic feature of Mo is an entirely novel finding to the inventors of the present invention in the field of the ferrite system stainless steel.

The inventors of the present invention have furthered their studies and have confirmed that W has a similar effect to that of Mo, and the thickness reduction quantity can be moreover decreased by adding Mo or W in combination with Si (Al).

Figure 2:
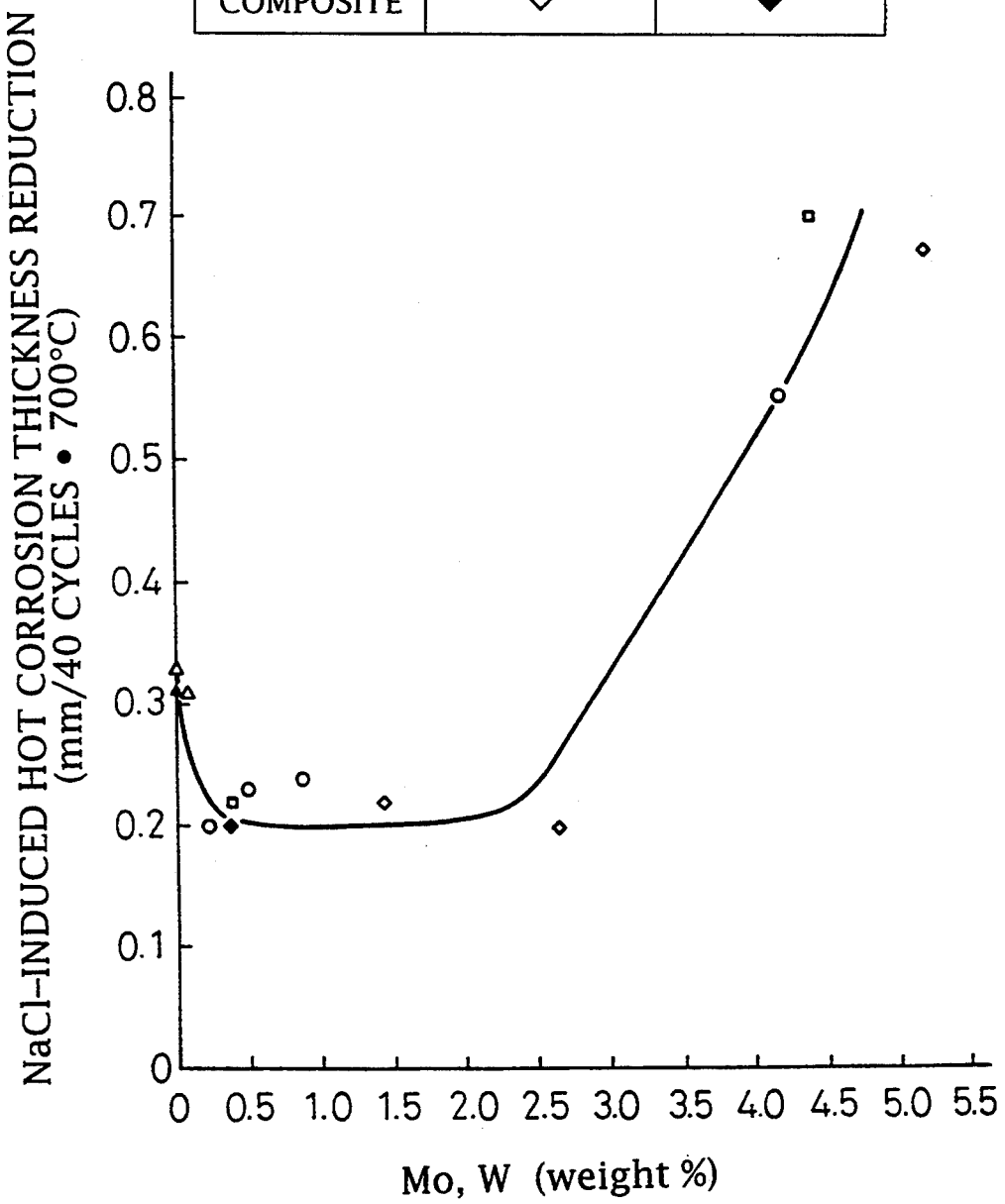
FIG. 2 is a graph showing the relationship between Mo and/or W content and NaCl-induced hot corrosion thickness reduction in a 17Cr, low Si alloy.
Figure 3:
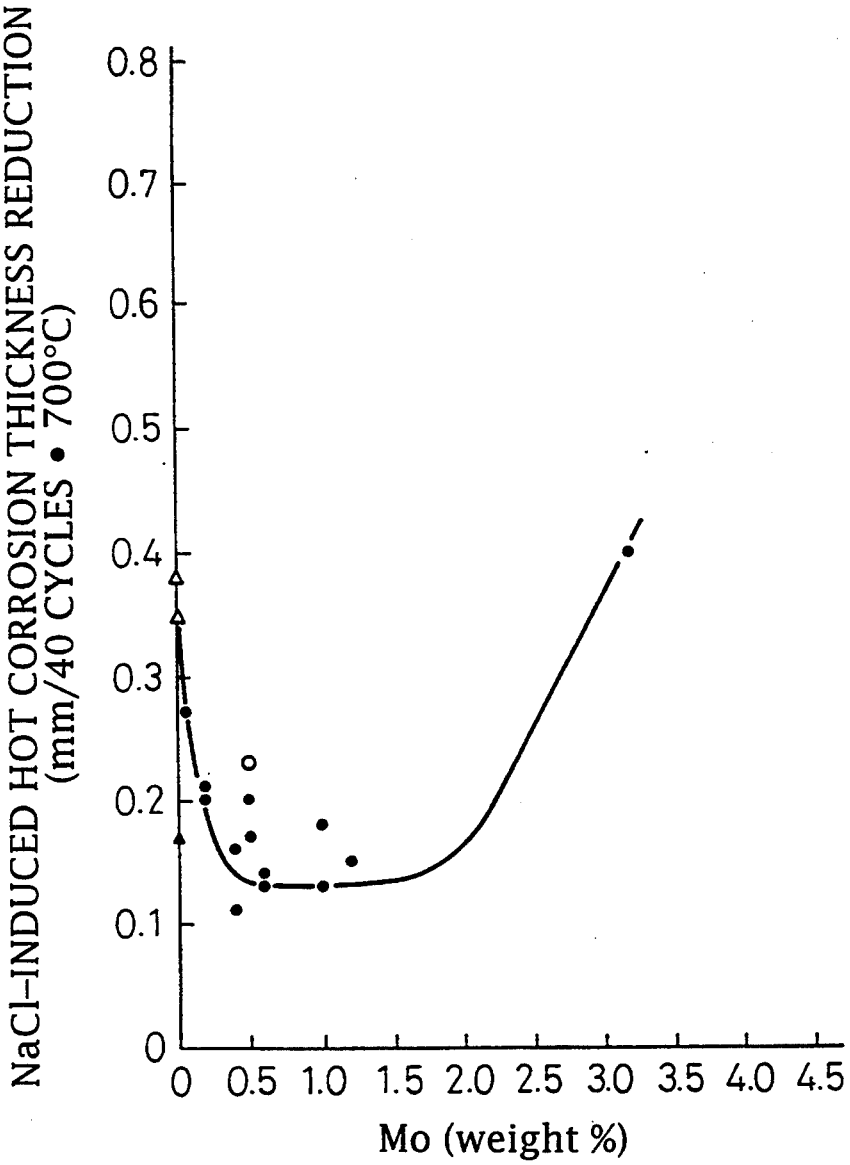
FIG. 3 is a graph showing the relationship between the Mo content and NaCl-induced hot corrosion thickness reduction in a 17Cr high Si alloy.

The results are shown in FIGS. 2 and 3. FIG. 2 shows the data of later-appearing Example 1, wherein Si is added within the range of 0.1 to 0.5 wt % in addition to Mo or W either alone or in combination. The table shows that when Mo and/or W is added in an amount ranging from 0.2 to 2.7%, a thickness reduction quantity near 0.2 mm/40 cycles can be obtained.

FIG. 3 shows the data of later-appearing Example 3, and shows the relationship between the Mo addition amount and the thickness reduction quantity when Si is added in an amount exceeding 0.5%. The diagram shows that the thickness reduction quantity falls within the range of 0.1 to 0.2 mm/40 cycles with 0.5% Mo being in the center, and that superior NaCl-induced corrosion resistance can be obtained in comparison with the case shown in FIG. 2.

In other words, it has been found out that when Mo or W is added in an amount in the range 0.1 to 2.0%, the NaCl-induced hot corrosion thickness reduction quantity can be drastically lowered.

Figure 4:
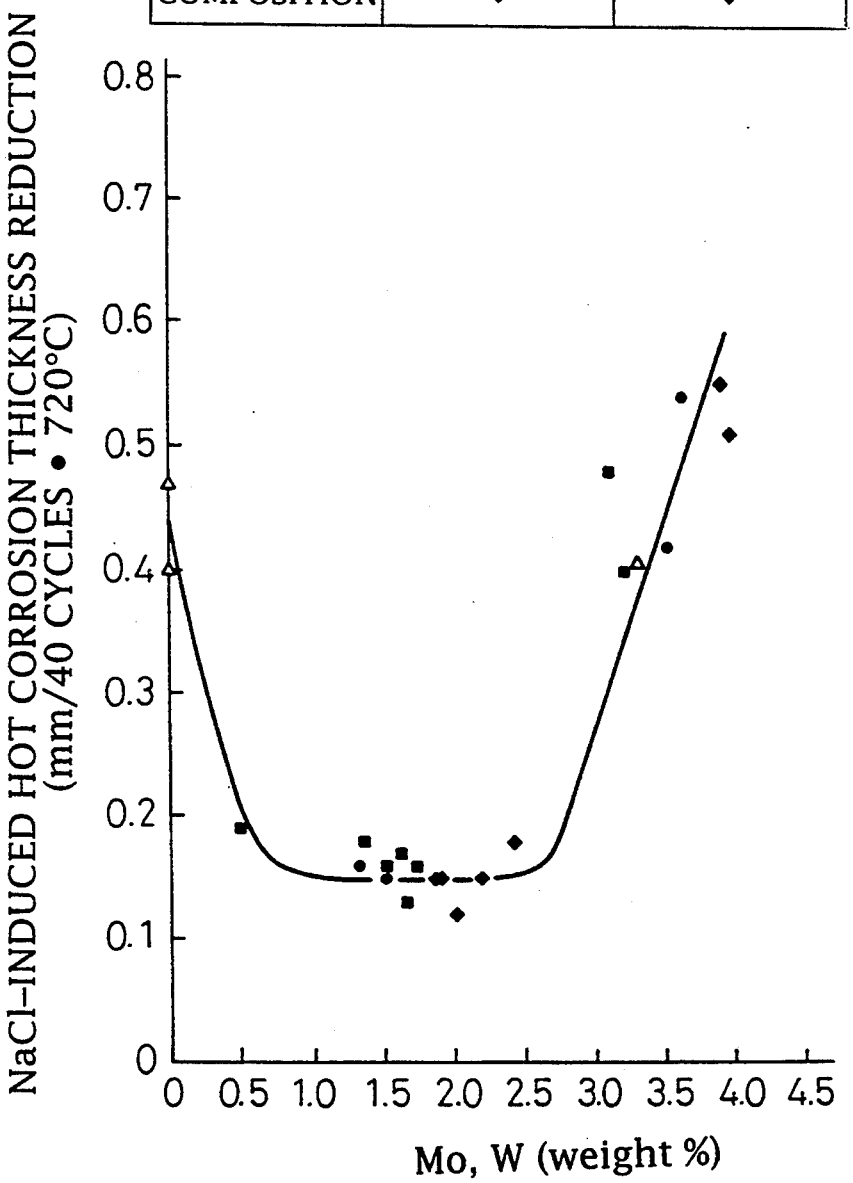
FIG. 4 is a graph showing the relationship between the Mo and/or W content and NaCl-induced hot corrosion thickness reduction in the 17C high Si alloy.

FIG. 4 shows the relationship between the thickness reduction quantity (mm/20 cycles) and the addition amounts of Mo and W under the following condition, on the basis of the result of Example 3. In this case, too, the thickness reduction quantity drastically decreases with Mo, W addition amounts of 0.5 to 2.5% being the center, and the same tendency as described above can be found out.

(1) The blank material is immersed in a 5% salt water for 10 minutes.

(2) The material is heated to 720° C. and retained at this temperature for 90 minutes.

(3) The material is then cooled by air for 5 minutes.

(4) The procedures described above are repeated 20 times.

As described above, Mo or W has an extremely remarkable effect to the NaCl-induced hot corrosion.

Figure 5:
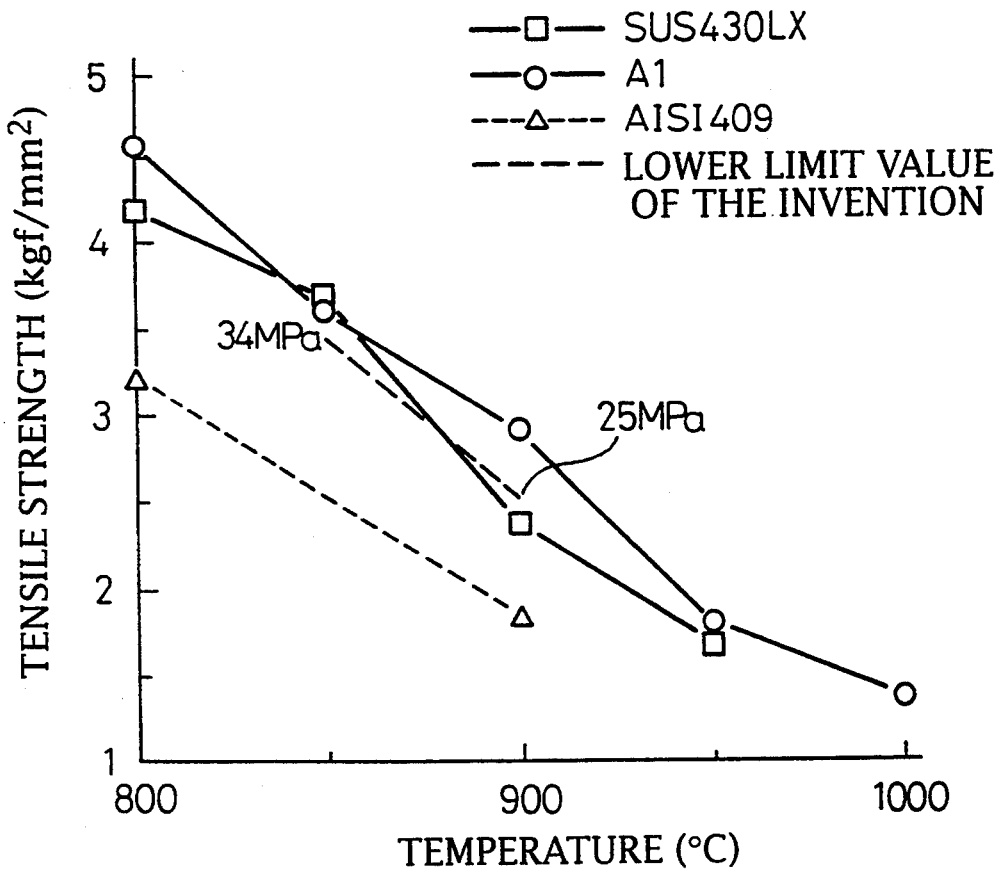
FIG. 5 is a graph showing the relationship between a temperature and a tensile strength in various alloys.

The present invention can sufficiently secure the solid solution Nb quantity as already described. Therefore, a tensile strength of at least 34 MPa at 850° C. and a tensile strength of at least 25 MPa at 900° C. can be secured as a high temperature strength before use, and excellent high temperature fatigue characteristics and excellent thermal fatigue characteristics can be secured, as tabulated in FIG. 5. This diagram represents the relationship between the tensile strength and the temperature, and demonstrates that the steel according to the present invention (indicated by a white circle in the diagram, Al steel in Table 3) has a high desired strength at high temperatures of 850° C. and 900° C. (In the diagram, a dotted line represents the lower limit value of the present invention.) Symbol □ represents a steel to which Mo and W are not added but only Nb is added (SUS430LX (19Cr 0.5Nb)), and its tensile strength drops above 900° C. Symbol Δ represents a steel to which only Ti is added (AISI409 (11Cr 0.3Ti))), and it exhibits a lower strength than the steel according to the present invention.

Next, the reasons why the components of the present invention are limited will be explained.

C: In the steel according to the present invention, the high temperature strength before and during use is primarily supported by solid solution strengthening of Nb and Mo, W, and in order to further improve workability and toughness of a hot rolled sheet, the C content is preferably limited to a lower content. However, an extreme reduction of C is economically disadvantageous, and since a part of the high temperature strength before use is supported by carbonitrides of Ti, Zr and Nb, the C content is limited to the range of 0.003 to 0.015% and at the same time, is so limited as to satisfy the following relation in combination with N:

$$C+N \leqq 0.03\%$$

Si: Silicon is effective as a deoxidizing agent and improves oxidation resistance and NaCl-induced hot corrosion resistance. Since the steel according to the present invention has a lower Cr content than SUS430LX, at least 0.1% of Si is necessary to improve oxidation resistance, particularly to improve oxidation resistance in an exhaust gas. Since Si is an element effective for improving the NaCl-induced hot corrosion resistance, a Si content of at least 0.5% is preferred. On the other hand, the lower limit is set to 1% because Si lowers workability and weldability.

Mn: Since manganese is a deoxidizing agent, at least 0.1% is necessary. It is one of the austenite formation elements, and the upper limit is set to 1% so as to prevent martensite transformation.

P: Though phosphorus is effective for increasing high temperature strength (solid solution strengthening), it reduces weldability. Therefore, the P content is limited to 0.01 to 0.1%.

S: Sulfur is a formation element of MnS and lowers corrosion resistance as the basic characteristics of the stainless steel. Therefore, the content is limited to not greater than 0.01%.

Cr: Chromium is effective for improving oxidation resistance and NaCl-induced hot corrosion resistance, and at least 13% is necessary to secure oxidation resistance near 900° C. As a temperature near 900° C. is regarded as the highest temperature at which the steel of the present invention will be used, the addition of Cr an amount exceeding 17% or more is not effective. Therefore, the upper limit is set at 17%.

Figure 6:
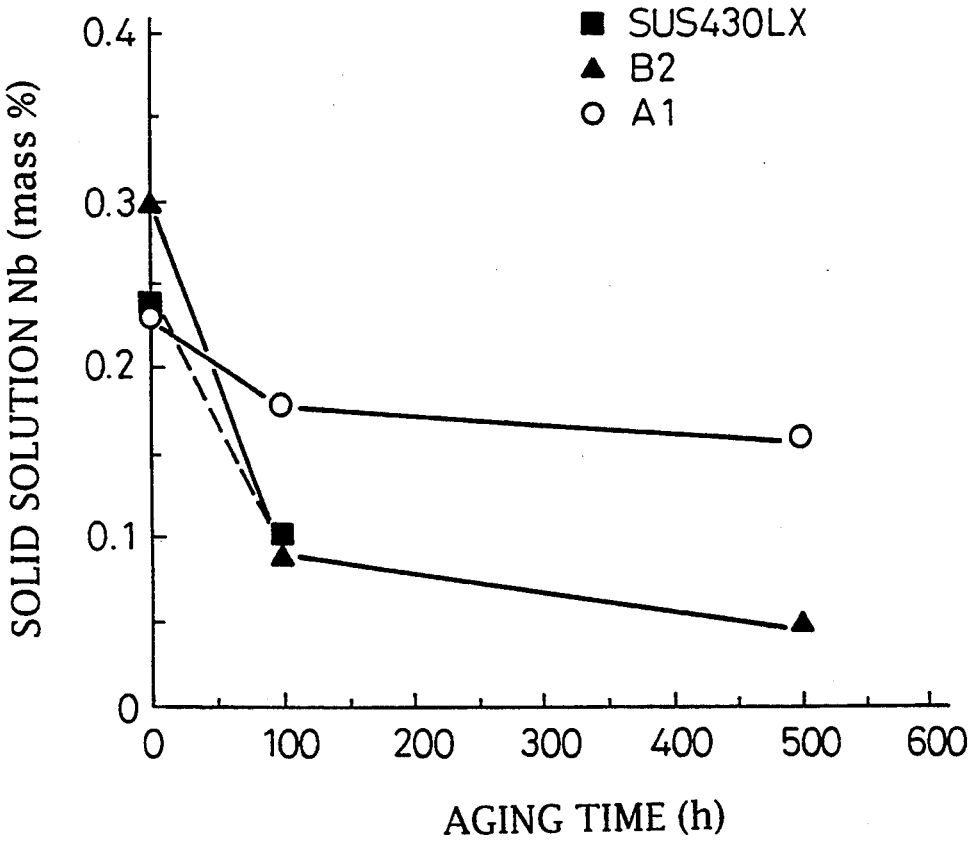
FIG. 6 is a graph showing the relationship between an aging time and a solid solution Nb amount with high temperature aging.

Nb: Niobium is an addition element to prevent grain growth at a weld portion and a weld influenced portion, and to secure a high temperature strength. However, since niobium has high affinity with C, N and Fe, it forms a precipitate during use. To allow the effect of solid solution strengthening of Nb to act more effectively, the amount of Nb is from 0.1 to less than 0.5%. Preferably, the Nb content is from 0.1 to 0.4% as eff. Nb when Ti alone is added as a C+N fixing element, and from 0.1 to 0.4% as eff. Nb when Zr alone is added or Ti and Zr are compositely added, as the C+N fixing element.

eff. Nb: This is an index for securing a high temperature strength during use. In the steel according to the present invention, solid solution Nb, Mo and W give high temperature strength and among them, solid solution Nb has the highest high-temperature strengthening effect. However, Nb is likely to form a precipitate with C, N and Fe, and a part of these elements is believed to contribute to high temperature strengthening in the same way as solid solution Nb. However, the precipitation phase aggregates and grows to coarse particles during use at a high temperature (during driving of an actual car) and solid solution Nb decreases. FIG. 6 (which is based on each sample of Example 2) shows the change of the solid solution Nb amount with simple aging at 900° C. while a continuous use at 900° C. is taken into consideration. Solid solution Nb decreases with aging.

However, the degree of the decrease is smaller in Al which is one of the steels of the present invention to which Ti (or Zr) and Nb are added, in comparison with SUS430Lx and B2 to which Nb is alone added.

This means that solid solution Nb as a high temperature strengthening factor is secured with the use at a high temperature and the high temperature strength of the members during use at a high temperature can be secured.

Figure 7:
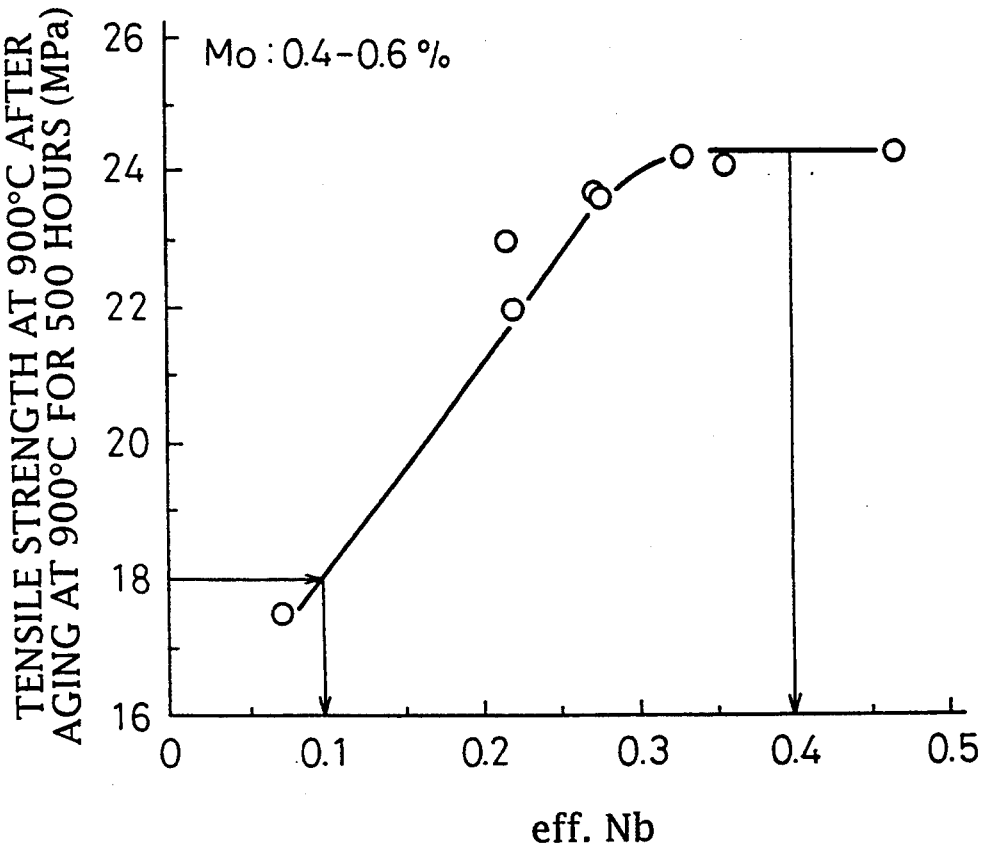
FIG. 7 is a graph showing the relationship between eff. Nb and a tensile strength at 900° C. after aging at 900° C. for 500 hours.
Figure 8:
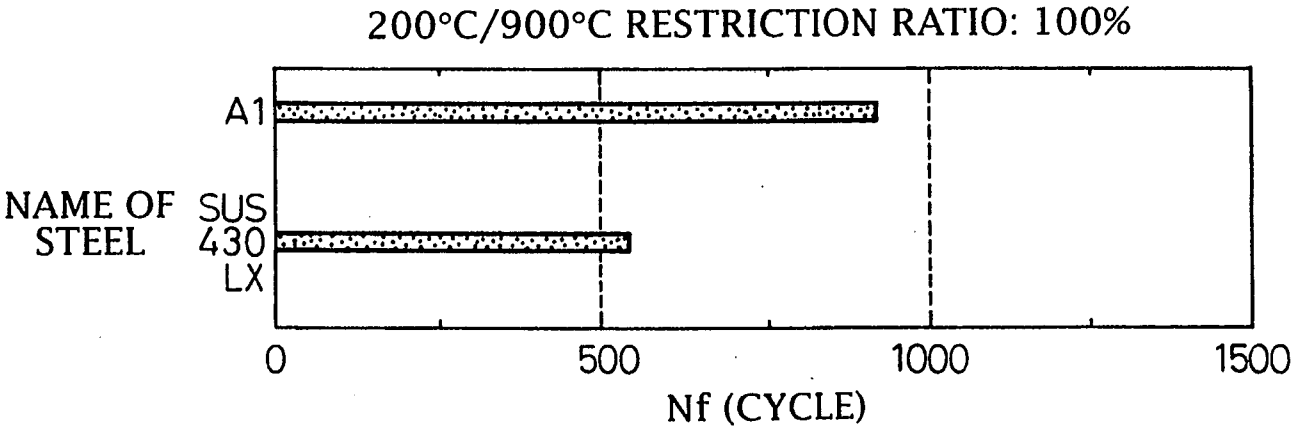
FIG. 8 is a graph showing the test results of a thermal fatigue test of Al and SUS430LX at 200°/900° C.

This is the effect brought forth by the addition of Ti or Zr, and to inhibit bonding between C and Nb, the amount of the solid solution Nb during the high temperature use can be secured. On the basis of this point, eff. Nb, that is, the factor relating to securing of the high temperature strength during the high temperature use, is determined in accordance with the following formulas when Ti, Zr and Nb are compositely added. As shown in FIG. 7 (which is based on the sample of 0.4 to 0.6% Mo in Example 2), the lower limit of the eff. Nb amount is set to 0.1 as the amount which can secure the high temperature strength (the tensile strength at 900° C.) of 18 MPa after aging at 900° C. for 500 hours in consideration of the high temperature use. When the amount exceeds 0.4, on the other hand, the rise of the high temperature strength due to the increase of eff. Nb gets into saturation. Therefore, the upper limit is set to 0.4%.

By the way, eff. Nb can be obtained by the following equations.

1. When Ti alone is added:

$$\text{eff. Nb}(\%) = \text{NB}(\%) - 3.93 \times fc/12 - 93 \times fn/14 \quad (1)$$

with the proviso that:

(1) when $\text{Ti}(\%) - 48 \cdot (\text{N}(\%)/2)/14 > 0$, in $\text{C}(\%) - 12 \cdot \{\text{Ti}(\%) - 48 \cdot (\text{N}(\%)/2)/14\}/48 > 0$, $fc = \text{C}(\%) - 12 \cdot \{\text{Ti}(\%) - 48 \cdot (\text{N}(\%)/2)14\}/48$ $fn = \text{N}(\%)/2$ in $\text{C}(\%) - 12 \cdot \{\text{Ti}(\%) - 48 \cdot (\text{N}(\%)/2/14\}/48 \leqq 0$, $fc = 0$ $fn = \text{N}(\%)/2$ (2) when $\text{Ti}(\%) - 48 \cdot (\text{N}(\%)/2)/14 \leqq 0$, $fc = \text{C}(\%)$ $fn = \text{N}(\%) - 14 \cdot (\text{Ti}(\%)/2)/48$ That is, (1) when the number of the Ti atoms is greater than $\frac{1}{2}$ of the number of the N atoms, one half of N is NbN and the other half is TiN.

i) When the number of the remaining Ti atoms from TiN is smaller than the number of the C atoms, C first changes to TiC and the rest becomes $Fe_3Nb_3C$.

ii) When the number of the remaining Ti atoms from TiN is greater than the number of the C atoms, C first becomes TiC.

(2) When the number of the Ti atoms is smaller than ½ of the number of the N atoms, N first changes to TiN and the rest becomes NbN.

2. When Zr alone is added:

$$\text{eff. Nb}(\%)=\text{Nb}(\%)-3.93\times fc/12-93\times fn/14 \quad (2)$$

with the proviso that:

(1) when $Zr(\%) - 91 \cdot (N(\%)/2)/14 > 0$, in $C(\%) - 12 \cdot \{Zr(\%) - 91 \cdot (N(\%)/2)/14\}/91 > 0$, $fc = C(\%) - 12 \cdot \{Zr(\%) - 91 \cdot (N(\%)/2)14\}/91$ $fn = N(\%)/2$ in $C(\%) - 12 \cdot \{Zr(\%) - 91 \cdot (N(\%)/2)/14\}/91 \leqq 0$, $fc = 0$ $fn = N(\%)/2$ (2) when $Zr(\%) - 91 \cdot (N(\%)/2)/14 \leqq 0$, $fc = C(\%)$ $fn = N(\%) - 14 \cdot (Zr(\%)/2)/91$ That is, (1) When the number of the Zr atoms is greater than ½ of the number of the N atoms, one half of N is NbN and the rest are ZrN.

i) When the number of the remaining Zr atoms from ZrN is smaller than the number of the C atoms, C first changes to ZrC and the rest becomes $Fe_3Nb_3C$.

ii) When the number of the remaining Zr atoms from ZrN is greater than the number of the C atoms, C becomes ZrC.

(2) When the number of the Zr atoms is smaller than ½ of the number of the N atoms, N first changes to ZrN and the rest becomes NbN.

3. When Zr and Ti are compositely added:

$$\text{eff. Nb}(\%)=\text{Nb}(\%)-3.93\times fc/12-93\times fn/14 \quad (3)$$

with the proviso that:

(1) when $Ti(\%) + 48/91 \cdot Zr(\%) - 48 \cdot (N(\%) \cdot 2/3)/14 > 0$,
in $C(\%) - 12 \cdot \{Ti(\%) + 48/91 \cdot Zr(\%) - 48 \cdot (N(\%) \cdot 2/3)/14\}/48 > 0$, $fc = C(\%) - 12 \cdot \{Ti(\%) + 48/91 \cdot Zr(\%) - 48 \cdot (N(\%) \cdot 2/3)/14\}/48 \leqq 0$, $fn = N(\%)/3$ in $C(\%) - 12 \cdot \{Ti(\%) + 48/91 \cdot Zr(\%) - 48 \cdot (N(\%) \cdot 2/3)/14\}/48 \leqq 0$ $fc = 0$ $fn = N(\%)/3$ (2) when $Ti(\%) + 48/91 \cdot Zr(\%) - 48 \cdot (N(\%) \cdot 2/3)/14 \leqq 0$, $fc = C(\%)$ $fn = N(\%) - 14 \cdot (Ti(\%)/2)/48 - 14 \cdot (Zr(\%)/2)/91$ That is, (1) When the sum of the numbers of the Zr and Ti atoms is greater than ⅔ of the number of the N atoms, ⅓ of N is NbN, and the remaining ⅔ is ZrN and TiN.

i) When the sum of the numbers of the remaining Zr and Ti atoms from ZrN and TiN is smaller than the number of the C atoms, C first becomes ZrC and TiC, and the rest becomes $Fe_3Nb_3C$.

ii) When the sum of the remaining Zr and Ti atoms from ZrN and TiN is greater than the number of the C atoms, C becomes ZrC and TiC.

(2) When the numbers of the Zr and Ti atoms are smaller than ⅔ of the number of the N atoms, N first becomes ZrN and TiN and the rest becomes NbN.

Ti: Titanium is an element which is necessary for fixing C+N, improving workability and securing stability of the metal phase texture for a long time. Ti has higher affinity with C and N than with Mo, W and Nb. Therefore, it functions to inhibit precipitation of carbonitrides of Nb, Mo and W during use. Accordingly, solid solution Mo, W and Nb during use can be secured, and hence high temperature strength during use can be secured. The minimum addition amount of Ti is set to 0.01% so as to fix C and N which do not undergo solid solution in the parent phase. Since a part of the high temperature strength before use is supported by the carbonitrides of Ti, the addition of Ti in an amount exceeding 0.5% will render the carbonitrides coarser, so that the high temperature strength before use drops. Further, the addition in an amount greater than 0.5% deteriorates the shape of the weld bead. Accordingly, the upper limit is set to 0.5%. When Ti is compositely added in combination with Zr, the amount of Ti+Zr is within the range of 0.01 to 0.5%.

Zr: Zirconium is an element which is necessary for fixing C+N, improving workability and securing stability of the metal phase structure for a long time. Since Zr has higher affinity with C and N than with Nb, Mo and W, it functions to inhibit precipitation of the carbonidrides of Nb, Mo and W. Accordingly, solid solution Nb, Mo and W during use can be secured, and the high temperature strength during use can also be secured. For this reason, the minimum addition amount of Zr is set to 0.01% so as to fix C and N. Since a part of the high temperature strength before use is supported by the carbonitrides of Zr, the addition of Zr in an amount exceeding 0.5% will make the carbonitrides coarser, so that the high temperature strength before use drops. Further, the addition in an amount exceeding 0.5% deteriorates the weld bead shape. For this reason, the upper limit is set to 0.5%. When Zr is compositely added in combination with Ti, the amount of Zr+Ti is set to the range of 0.01 to 0.5%.

W: Tungsten is an addition element for improving the high temperature strength and the NaCl-induced hot corrosion resistance and at least 0.1% must be added. Since W is more difficult to precipitate than Nb, the solid solution amount can be secured during use, and W is effective for keeping the high temperature strength during use. However, since it deteriorates the NaCl-induced hot corrosion resistance, the upper limit is set to 2% when used alone and to 3% when used compositely in combination with Mo. By the way, w is one of the elements which raises the recrystallization temperature and might precipitate a large amount of intermetallic compounds with Fe and carbonitrides. Accordingly, the upper and lower limits are determined by also taking this property into consideration.

Mo: Molybdenum is an addition element which improves the high temperature strength and the high temperature brine damage resistance. Since the steel of the present invention characterizingly has a low Cr content, at least 0.1% of Mo must be added in order to improve the corrosion resistance as the basic characteristics of the stainless steel. Since Mo is more difficult to precipitate than Nb and the solid solution quantity can also be secured during use, Mo is effective for keeping the high temperature strength during use. However, the addition of Mo in a great amount will deteriorate the NaCl-induced hot corrosion resistance. Therefore, the upper limit is set to 2% when used alone and to 3% when used compositely in combination with W. Furthermore, since molybdenum is one of the elements which might raise the recrystallization temperature and might precipitate large quantities of intermetallic compounds with Fe and carbonitrides, the upper and lower limits are determined in consideration of this point, too.

Al: Aluminum is an element which is effective as a deoxidizing agent and improves the oxidation resistance as well as the NaCl-induced hot corrosion resistance. Since the steel of the present invention has lower Cr content than SUS430LX, aluminum is a useful addition element from the aspect of the improvement in the oxidation resistance particularly in an exhaust gas. Since it is a useful element for improving the NaCl-induced hot corrosion resistance, at least 0.02% is preferably added. On the other hand, since aluminum lowers workability and deteriorates the weld bead shape, the upper limit is set to 0.3%. When aluminum is compositely added with Si, the NaCl-induced corrosion resistance can further be improved.

N: In the steel of the present invention, the high temperature strength is primarily supported by the solid solution strengthening effect of Nb, Mo and W, and from the aspect of the improvement of workability and toughness of the hot rolled sheet, the N content must be reduced as much as possible. However, extreme reduction of the N content will result in economical disadvantages. Therefore, the upper limit is set to 0.02% when used alone and $C+N \leqq 0.03\%$ in combination with C, as a level which does not lower the high temperature strength.

Rare earth elements (lanthanoids and misch metals containing Y): In the steel of the present invention, the Cr content is limited to a low range of 13 to 17%, and Si and Al are added so as to improve the oxidation resistance. The rare earth metal elements are added when a further improvement in the oxidation resistance is necessary. However, if the addition amount is less than 0.001%, a stable effect cannot be obtained and if it exceeds 0.05%, on the other hand, hot workability drops. Accordingly, the addition amount is set to a range of 0.001 to 0.05%.

High temperature strength: Due to the improvement in fuel-to-cost performance and higher output of automobiles, the exhaust gas temperature can now be high as about 900° C. Accordingly, in order to withstand thermal fatigue and high temperature fatigue under this condition, the tensile strength is set to at least 34 MPa at 850° C. and to at least 25 MPa at 900° C. Since solid solution Nb as the strengthening factor drops during the high temperature use, the high temperature strength also drops, with high temperature use. To show securing the high temperature strength during the high temperature use, FIG. 7 shows an example where the tensile strength of at least 18 MPa is secured at 900° C. after the steel of the present invention containing 0.4 to 0.6% of Mo is aged at 900° C. for 500 hours.

EXAMPLES

Example 1

Eight kilograms of each of the sample steels each having a chemical composition tabulated in Table 1 was produced by vacuum melting, and a thin sheet having a thickness of 2 mm was produced through steps of heating at 1,250° C., hot rolling, pickling, cold rolling, annealing at 850° to 1,000° C. and pickling. A tensile test, a cycle aging test, a NaCl-induced hot corrosion test and a high temperature tensile test were carried out using each of these thin sheets, and the resulting properties were tabulated in Table 2.

TABLE 1

| Name of steel | | C | Si | Mn | P | S | Cr | Ti | Mo | W | Nb | N | C+N | Mo+W | (weight %) eff. Nb |
|---|---|---|---|---|---|---|---|---|---|---|---|---|---|---|---|
| Steels of the invention | NUS13 | 0.011 | 0.3 | 0.5 | 0.03 | 0.003 | 16.0 | 0.40 | 0.48 | — | 0.38 | 0.011 | 0.022 | 0.48 | 0.343 |
| | NUS16 | 0.010 | 0.3 | 0.3 | 0.04 | 0.007 | 16.3 | 0.45 | — | 0.39 | 0.37 | 0.011 | 0.021 | 0.39 | 0.333 |
| | NUS21 | 0.013 | 0.5 | 0.2 | 0.02 | 0.006 | 14.0 | 0.25 | 1.87 | 0.80 | 0.22 | 0.010 | 0.023 | 2.67 | 0.181 |
| | NUS22 | 0.010 | 0.5 | 0.3 | 0.03 | 0.005 | 15.1 | 0.34 | 0.78 | 0.58 | 0.28 | 0.012 | 0.022 | 1.46 | 0.240 |
| Comperative steels | NUS24 | 0.013 | 0.5 | 0.3 | 0.02 | 0.008 | 13.2 | — | 4.20 | — | — | 0.012 | 0.025 | 4.20 | — |
| | NUS25 | 0.032 | 0.6 | 0.2 | 0.03 | 0.005 | 12.7 | 0.11 | — | — | 0.12 | 0.020 | 0.052 | — | −0.25 |
| | NUS26 | 0.020 | 0.5 | 0.3 | 0.02 | 0.006 | 13.3 | — | — | 4.40 | — | 0.009 | 0.029 | 4.40 | — |
| | NUS27 | 0.021 | 0.5 | 0.2 | 0.03 | 0.004 | 12.5 | 0.31 | 3.09 | 2.12 | — | 0.009 | 0.030 | 5.21 | — |
| | NUS28 | 0.013 | 0.4 | 0.3 | 0.02 | 0.006 | 19.5 | 0.21 | 0.22 | — | — | 0.012 | 0.025 | 0.22 | — |
| | NUS29 | 0.012 | 0.5 | 0.1 | 0.02 | 0.007 | 12.3 | 0.67 | 0.87 | — | 0.19 | 0.011 | 0.023 | 0.87 | 0.153 |
| | NUS30 | 0.012 | 1.2 | 0.4 | 0.02 | 0.005 | 13.6 | 0.27 | 0.22 | 0.15 | — | 0.013 | 0.025 | 0.37 | — |
| | AISI409 | 0.015 | 0.3 | 0.2 | 0.02 | 0.007 | 11.1 | 0.28 | — | — | — | 0.013 | 0.028 | — | — |
| | SUS430LX | 0.015 | 0.5 | 0.2 | 0.02 | 0.006 | 18.7 | — | — | — | 0.60 | 0.018 | 0.033 | — | 0.132 |

TABLE 2

| Name of steels | | Tensile strength at 900° C. ($N/mm^2$) | Tensile strength at 900° C. after cycle aging ($N/mm^2$) | NaCl-induced hot corrosion thickness reduction (mm/40 cycles) | Normal temperature tensile breaking ductility (%) |
|---|---|---|---|---|---|
| Steels of the invention | NUS13 | 26.8 | 25.6 | 0.23 | 35 |
| | NUS16 | 26.8 | 25.3 | 0.22 | 36 |
| | NUS21 | 27.3 | 26.8 | 0.20 | 33 |
| | NUS22 | 27.0 | 26.0 | 0.22 | 34 |
| Comparative steels | NUS24 | 27.6 | 26.5 | 0.55 | 31 |
| | NUS25 | 15.3 | 13.5 | 0.31 | 31 |
| | NUS26 | 27.1 | 26.5 | 0.70 | 31 |
| | NUS27 | 28.0 | 26.8 | 0.67 | 30 |

TABLE 2-continued

| Name of steels | Tensile strength at 900° C. ($N/mm^2$) | Tensile strength at 900° C. after cycle aging ($N/mm^2$) | NaCl-induced hot corrosion thickness reduction (mm/40 cycles) | Normal temperature tensile breaking ductility (%) |
|---|---|---|---|---|
| NUS28 | 23.0 | 22.0 | 0.20 | 36 |
| NUS29 | 22.8 | 22.1 | 0.24 | 36 |
| NUS30 | 23.8 | 22.9 | 0.20 | 30 |
| AISI409 | 14.8 | 12.8 | 0.31 | 36 |
| SUS430LX | 25.9 | 23.8 | 0.33 | 32 |

(NOTE): Supplementary explanation of the testing methods described above:
1 Cycle aging: This test simulated a driving pattern of an automobile, and one cycle comprised heating, retaining at 800° C. for 30 minutes, retaining at 900° C. for 10 minutes and cooling by air, under free expansion/contraction state in an atmosphere of the automobile exhaust gas. The test comprised 40 cycles of this cycle.
2 NaCl-induced hot corrosion thickness reduction: A pattern of immersion in saturated salt water for minutes, retention at 700° C. for 120 minutes and cooling by air for minutes constituted one cycle, and after 40 cycles were completed, the reduction of thickness was measured.

As to the NaCl-induced hot corrosion resistance, the steels of the present invention (NUS13, 16, 21 and 22) to which 0.39% of Mo and 0.48% of W were individually added and to which 1.46% of Mo and 2.67% of W were compositely added, respectively, exhibited good values with small reduction of thickness due to corrosion. On the other hand, in the case of NUS 24, 26 and 27 to which Mo and W were added in excess, the NaCl-induced hot corrosion thickness reduction became great and moreover, normal temperature ductility was low. In the case of NUS30 having a high Si content, the NaCl-induced hot corrosion resistance was high, but normal temperature ductility was low.

As to the high temperature strength, the high temperature strength after cycle aging was low in NUS25 having a small eff. Nb amount, and was also low before and after cycle heating in NUS 28 and 30 to which Nb was not added. Further, in the case of NUS29 in which the eff. Nb amount was within the range of the present invention but Ti was added in excess, the high temperature strength at the initial stage was low. The steels of the present invention having eff. Nb contents in the range of 0.187 to 0.343 could secure the high temperature strength before and after cycle aging, and also had excellent normal temperature ductility.

Example 2

Sample steels each having a chemical composition tabulated in Table 3 were molten into a slab by vacuum melting, and thin sheets having thickness of 2 mm were produced through the steps of slab heating at 1,250° C., hot rolling, pickling, cold rolling, annealing at 850° to 1,000° C. and pickling. The solid solution Mo and Nb amounts were measured at each of the steps described above, and finally, a tensile test, a NaCl-induced hot corrosion test and a high temperature tensile test were carried out using each of the cold rolled annealed sheets so as to measure various characteristics.

TABLE 3

| Name of steels | | C | Si | Mn | P | S | Cr | Ti | Mo | Nb | Al | N | C+N | Rem* | eff. Nb |
|---|---|---|---|---|---|---|---|---|---|---|---|---|---|---|---|
| Steels of the invention | A1 | 0.012 | 0.60 | 0.4 | 0.03 | 0.004 | 14.1 | 0.12 | 0.51 | 0.31 | 0.05 | 0.010 | 0.022 | — | 0.277 |
| | A2 | 0.014 | 0.52 | 0.3 | 0.02 | 0.005 | 13.2 | 0.15 | 0.60 | 0.25 | 0.14 | 0.010 | 0.024 | — | 0.217 |
| | A3 | 0.013 | 0.71 | 0.2 | 0.02 | 0.006 | 13.7 | 0.08 | 0.40 | 0.36 | 0.03 | 0.009 | 0.022 | — | 0.330 |
| | A4 | 0.008 | 0.80 | 0.1 | 0.03 | 0.007 | 13.5 | 0.06 | 1.00 | 0.20 | 0.02 | 0.009 | 0.017 | | 0.170 |
| | A5 | 0.010 | 0.61 | 0.4 | 0.02 | 0.003 | 14.2 | 0.10 | 0.20 | 0.41 | 0.07 | 0.009 | 0.019 | — | 0.380 |
| | A6 | 0.015 | 0.51 | 0.2 | 0.02 | 0.006 | 13.1 | 0.30 | 0.60 | 0.32 | 0.19 | 0.014 | 0.029 | — | 0.274 |
| | A7 | 0.010 | 0.52 | 0.2 | 0.02 | 0.006 | 13.2 | 0.10 | 0.20 | 0.38 | 0.08 | 0.010 | 0.020 | 0.01 | 0.347 |
| | A8 | 0.014 | 0.51 | 0.2 | 0.02 | 0.006 | 13.9 | 0.25 | 1.20 | 0.20 | 0.03 | 0.010 | 0.024 | 0.04 | 0.167 |
| Comparative steels | B1 | 0.016 | 0.53 | 0.2 | 0.02 | 0.006 | 13.9 | 0.10 | 3.20 | 0.30 | 0.05 | 0.014 | 0.030 | — | 0.254 |
| | B2 | 0.015 | 0.89 | 0.7 | 0.03 | 0.007 | 13.0 | — | — | 0.50 | 0.04 | 0.010 | 0.025 | — | 0.085 |
| | B3 | 0.014 | 0.65 | 0.2 | 0.03 | 0.005 | 14.0 | 0.67 | 0.50 | 0.25 | 0.05 | 0.009 | 0.023 | — | 0.220 |
| | B4 | 0.030 | 0.51 | 0.2 | 0.02 | 0.006 | 13.0 | 0.10 | 1.00 | 0.23 | 0.01 | 0.015 | 0.045 | — | −0.0085 |
| | B5 | 0.016 | 0.54 | 0.2 | 0.02 | 0.006 | 13.9 | 0.15 | 0.40 | 0.39 | 0.04 | 0.010 | 0.026 | — | 0.357 |
| | B6 | 0.013 | 0.38 | 0.2 | 0.02 | 0.006 | 13.0 | 0.10 | 0.50 | 0.50 | 0.05 | 0.010 | 0.023 | — | 0.467 |
| | B7 | 0.011 | 0.53 | 0.2 | 0.02 | 0.006 | 13.0 | 0.005 | 0.02 | 0.40 | 0.04 | 0.009 | 0.023 | — | 0.071 |
| | B8 | 0.016 | 0.55 | 0.2 | 0.02 | 0.006 | 13.9 | 0.10 | 0.80 | 0.38 | 0.05 | 0.010 | 0.026 | 0.1 | 0.347 |
| | AISI409 | 0.020 | 0.30 | 0.2 | 0.02 | 0.006 | 10.9 | 0.30 | — | — | 0.02 | 0.012 | 0.032 | — | — |
| | SUS430LX | 0.016 | 0.50 | 0.7 | 0.02 | 0.006 | 18.4 | — | — | 0.50 | 0.02 | 0.012 | 0.028 | — | 0.048 |

Chemical composition of sample steels; weight %
*: analytical values of misch metals Table 4 illustrates the material characteristics of steels of the present invention in comparison with those of the comparative steels.

TABLE 4

| Name of steels | | Tensile strength at 90° C. (MPa) | Tensile strength at 900° C. after aging at 900° C. for 500 hrs. (MPa) | NaCl induced hot corrosion thickness reduction (mm/40 cycle) | Normal temperature tensile breaking ductility (%) | Existence of abnormal oxidation after left in exhaust gas of 900° C. for 500 hrs. | Weld bead shape |
|---|---|---|---|---|---|---|---|
| Steels of the invention | A1 | 28.2 | 23.6 | 0.17 | 35 | no abnormal oxidation | excellent |
| | A2 | 27.9 | 23.0 | 0.13 | 35 | " | " |

TABLE 4-continued

| Name of steels | | Tensile strength at 90° C. (MPa) | Tensile strength at 900° C. after aging at 900° C. for 500 hrs. (MPa) | NaCl induced hot corrosion thickness reduction (mm/40 cycle) | Normal temperature tensile breaking ductility (%) | Existence of abnormal oxidation after left in exhaust gas of 900° C. for 500 hrs. | Weld bead shape |
|---|---|---|---|---|---|---|---|
| | A3 | 28.0 | 24.2 | 0.16 | 35 | " | " |
| | A4 | 26.0 | 23.0 | 0.13 | 33 | " | " |
| | A5 | 28.5 | 24.5 | 0.20 | 35 | " | " |
| | A6 | 27.8 | 23.7 | 0.14 | 36 | " | " |
| | A7 | 28.5 | 23.9 | 0.21 | 35 | " | " |
| | A8 | 27.4 | 23.7 | 0.15 | 36 | " | " |
| Comparative steels | B1 | 28.6 | 25.0 | 0.40 | 35 | no abnormal oxidation | excellent |
| | B2 | 28.2 | 17.5 | 0.17 | 33 | " | " |
| | B3 | 23.9 | 22.0 | 0.20 | 36 | " | inferior |
| | B4 | 25.5 | 16.3 | 0.18 | 33 | abnormal oxidation at end of sample | excellent |
| | B5 | 27.9 | 24.1 | 0.11 | 31 | no abnormal oxidation | inferior |
| | B6 | 29.0 | 24.3 | 0.23 | 35 | abnormal oxidation at end of sample | excellent |
| | B7 | 27.0 | 17.5 | 0.27 | 32 | no abnormal oxidation | " |
| | AISI409 | 14.8 | 10.8 | 0.38 | 36 | " | " |
| | SUS430LX | 26.0 | 17.0 | 0.35 | 33 | " | " |

NaCl-induced hot corrosion: A pattern of immersion into saturated salt water for 5 minutes, retention at 700° C. for 120 minutes and cooling by air for 5 minutes constituted one cycle, and the test was completed by 40 cycles.
Weld bead shape: Welding was carried out for 30 cmm by bead open plate by MIG welding, and the width and height of the weld bead were measured. The weld bead having a width of at most 7 nm and a height of at most 3 mm was judged as excellent.

As can be understood from Table 4, the comparative steel B2 to which Nb was alone added, 430Lx, B4 having a high C+N content and B7 having a small Ti addition amount had the high high-temperature strength before use, but since eff. Nb was below 0.1% in all of these steels, their high temperature strength after the aging treatment dropped to a tensile strength of below 18 MPa which was not greater than 70% of the high temperature strength before use. In contrast, the steels A1 to A8 of the present invention, which contained Ti, Nb, Mo and C+N in good balance and which secured elf. Nb, had a high strength before use and could secure a high temperature strength of about 23 MPa even after the aging treatment.

It was found out that thermal fatigue life of the steel A1 of the present invention could last about 1.6 times longer than SUS430LX. This is because Ti fixed C+N and consequently, the operation of the high temperature strengthening of the solid solution Nb and Mo was allowed to effectively operate for a long time. In this way, thermal fatigue life could be drastically extended.

By the way, the thermal fatigue test was carried out in the following way. A testpiece which was a thin sheet having a thickness of 2 mm was used, and while it was restricted (complete restriction or 100% restriction) so that the gauge length was not extended or contracted by heating and cooling, the portion between the gauge marks was held in advance at 200° C. Using this point as a start, the temperature was raised from 200° C. to 900° C. in the course of 60 seconds, held at 900° C. for 30 seconds and cooled to 200° C. in the course of 60 seconds, as one cycle. This cycle was repeated until a load dropped to 10% of an initial load, and this point was regarded as breakage and it was used as a number of repetition of breakage (Nf).

In the case of the steel B6 having high eff. Nb, the high temperature strength was excellent after the aging treatment but in comparison with A3 having substantially the same Mo and C+N contents and with A5 and A7 having high eff. Nb, the high temperature strength after the aging treatment remained at substantially the same level, and a chemical composition of greater than 0.4% as eff. Nb was not effective. For, when the content exceeded 0.4% in terms of eff. Nb, the intermetallic compound between Fe and Nb became coarser and precipitation strengthening did not effectively operate.

When the C+N content exceeded 0.03%, the solid solution Nb amount became difficult to secure, and the high temperature strength after the aging treatment could not be retained as in the steel B4. The strengthening effect by Ti (C,N) became more difficult to develop. As could be appreciated from B3, when Ti was added in excess, the high temperature strength before use became lower and the weld bead shape also became inferior. The addition of Mo was effective for improving the high temperature strength and at the same time, it improved the NaCl-induced hot corrosion resistance as could be understood from comparison of A4 and A8 having a high Mo addition amount with B7 having a low addition amount.

On the other hand, as could be understood from the example of B1, excessive addition of Mo lowered the NaCl-induced hot corrosion resistance. As to the NaCl-induced hot corrosion resistance, Si was effective, too, and this effect could be observed obviously from the examples of A3 and B2. As could also be understood from the comparison A2 and A6 with B6, Si improved the oxidation resistance. To particularly prevent abnormal oxidation in exhaust gas at 900° C. for 500 hours, the addition of at least 0.5% of Si was necessary. When about 1% of Si was added, breaking elongation at the normal temperature tensile test did not drop as could be understood from the examples of A3, A4 and B2. It was also found that Al, the same as Si, improved the oxidation resistance and the NaCl-induced hot corrosion resistance as could be clearly understood from the examples of A2 and A6. On the other hand, when a large amount of Al was added, normal temperature ductility tended to drop and the weld bead shape became inferior as could be understood from B5.

Incidentally, since B8 contained large quantities of the rare earth elements, hot rolling was not possible.

Figure 9:
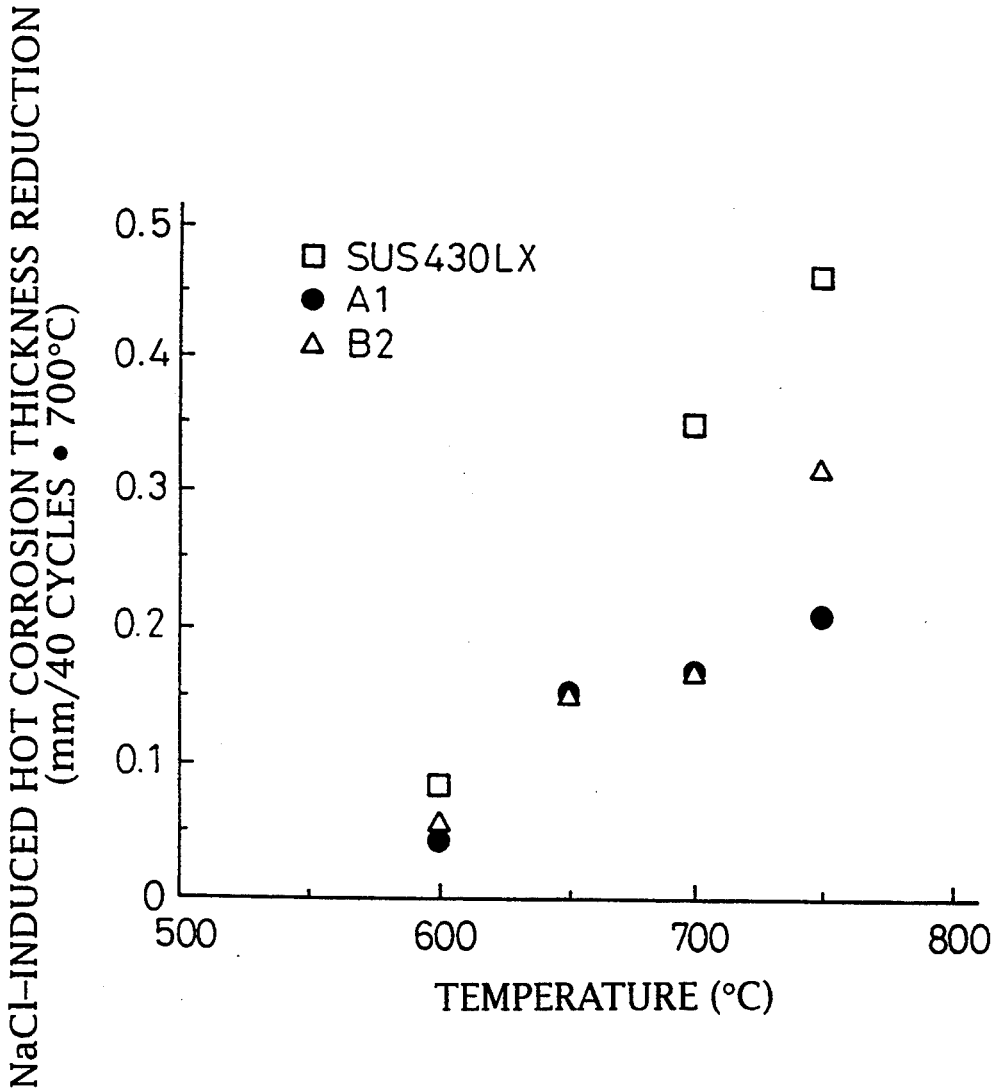
FIG. 9 is a graph showing the relationship between the temperature and corrosion thickness reduction.
Figure 10:
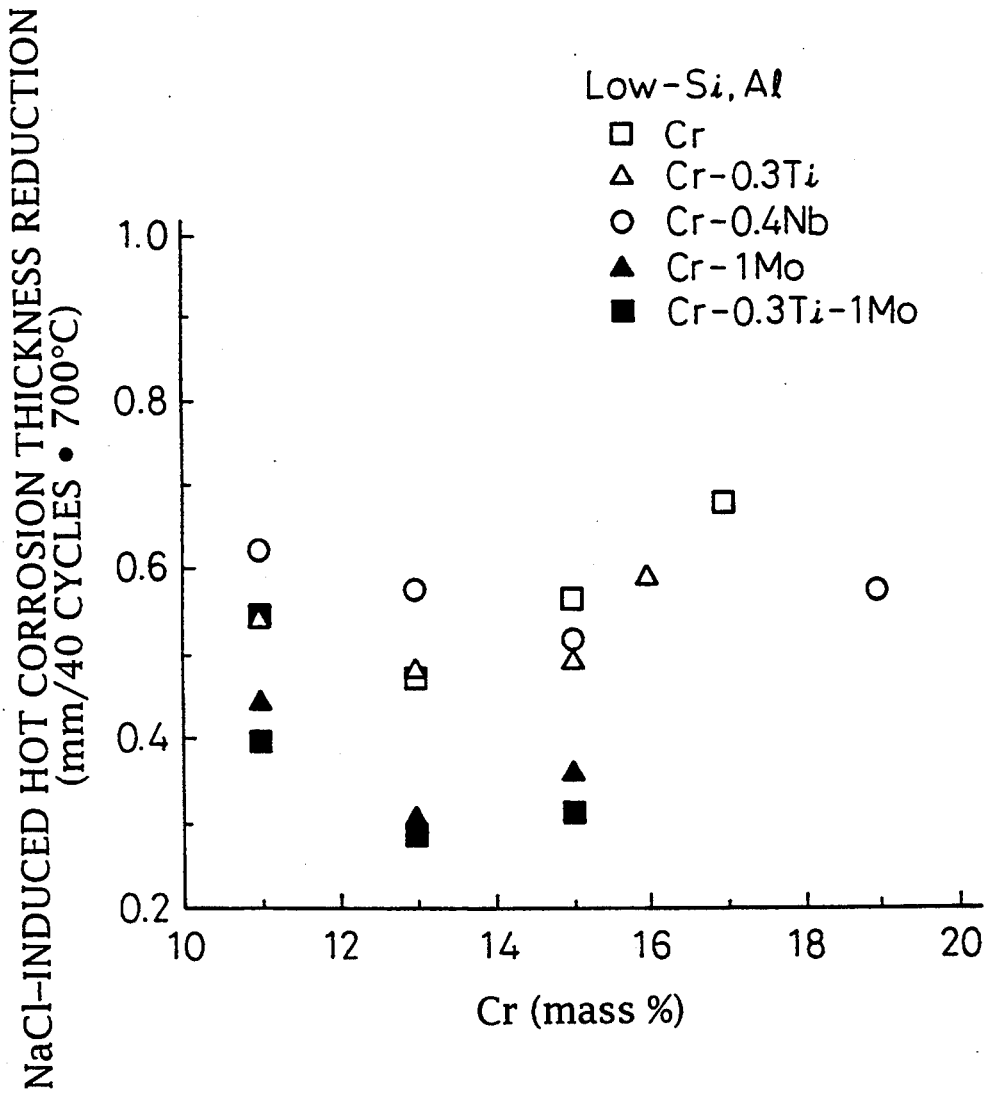
FIG. 10 is a graph showing the influences of a Cr content on the NaCl-induced hot corrosion resistance.

Next, FIG. 9 shows the relationship between the temperature and the corrosion thickness reduction as to the NaCl-induced hot corrosion of the steel A1 of the present invention, the comparative steel B2 and SUS430LX. As shown in the diagram, A1 and B2 had the same thickness reduction by 700° C. but the thickness reduction of B2 at 750° C. increased by 0.1 mm/40 cycles in comparison with that of A1. Thickness reduction of nearly three times that of A1 occurred at 700° C. in SUS430LX.

These results demonstrate that the steels of the present invention had extremely high resistance to the NaCl-induced hot corrosion.

Example 3

Sample steels each having a chemical composition tabulated in Table 5 were melted by vacuum melting and cast. Thereafter, thin sheets having a thickness of 2 mm were produced through the steps of slab heating at 1,250° C., hot rolling, pickling, cold rolling, annealing at 850° to 1,000° C. and pickling. A tensile test, a NaCl-induced hot corrosion test and a high temperature tensile test were carried out using each of the cold rolled and annealed sheets thus produced, and various properties were tabulated in Table 6. Table 6 also shows the degrees of breakage during hot rolling.

TABLE 5

| Name of steels | | C | Si | Mn | P | S | Cr | Ti | W | Nb | Al | N | C+N | Mo | Zr | Rem* | eff. Nb |
|---|---|---|---|---|---|---|---|---|---|---|---|---|---|---|---|---|---|
| Steels of the invention | A9 | 0.011 | 0.53 | 0.31 | 0.02 | 0.006 | 16.1 | 0.13 | 0.51 | 0.35 | 0.03 | 0.009 | 0.020 | — | — | — | 0.320 |
| | A10 | 0.013 | 0.55 | 0.33 | 0.03 | 0.007 | 14.9 | 0.12 | 1.73 | 0.27 | 0.04 | 0.009 | 0.022 | — | — | — | 0.240 |
| | A11 | 0.010 | 0.67 | 0.40 | 0.02 | 0.004 | 13.9 | — | 1.37 | 0.30 | 0.05 | 0.010 | 0.022 | — | −0.19 | — | 0.267 |
| | A12 | 0.012 | 0.80 | 0.37 | 0.02 | 0.005 | 13.9 | — | — | 0.32 | 0.04 | 0.011 | 0.023 | 1.52 | 0.23 | — | 0.272 |
| | A13 | 0.010 | 0.70 | 0.45 | 0.02 | 0.006 | 13.5 | — | 1.10 | 0.30 | 0.04 | 0.010 | 0.020 | 1.32 | 0.17 | — | 0.234 |
| | A14 | 0.013 | 0.69 | 0.50 | 0.03 | 0.005 | 13.5 | 0.08 | 1.62 | 0.40 | 0.03 | 0.009 | 0.022 | −0.15 | — | — | 0.380 |
| | A15 | 0.014 | 0.57 | 0.30 | 0.03 | 0.004 | 15.5 | 0.07 | — | 0.37 | 0.03 | 0.010 | 0.024 | 1.33 | 0.18 | — | 0.349 |
| | A16 | 0.012 | 0.75 | 0.30 | 0.03 | 0.003 | 13.3 | 0.10 | 0.98 | 0.25 | 0.04 | 0.010 | 0.022 | 1.01 | 0.08 | — | 0.228 |
| | A17 | 0.011 | 0.60 | 0.40 | 0.02 | 0.007 | 13.1 | 0.11 | 1.53 | 0.29 | 0.04 | 0.009 | 0.020 | — | — | 0.02 | 0.260 |
| | A18 | 0.009 | 0.52 | 0.31 | 0.02 | 0.006 | 13.2 | — | 0.98 | 0.32 | 0.03 | 0.011 | 0.020 | 0.89 | 0.20 | 0.03 | 0.283 |
| | A19 | 0.009 | 0.53 | 0.32 | 0.03 | 0.005 | 13.1 | 0.09 | 1.21 | 0.24 | 0.04 | 0.010 | 0.021 | 0.98 | 0.10 | 0.04 | 0.218 |
| Comparative steels | B9 | 0.013 | 0.61 | 0.31 | 0.02 | 0.005 | 15.3 | 0.13 | 3.10 | 0.33 | 0.03 | 0.011 | 0.024 | — | — | — | 0.293 |
| | B10 | 0.007 | 0.53 | 0.40 | 0.02 | 0.007 | 13.1 | 0.10 | 1.66 | 0.44 | 0.02 | 0.008 | 0.015 | −0.10 | — | — | 0.422 |
| | B11 | 0.011 | 0.44 | 0.40 | 0.02 | 0.007 | 13.9 | — | 3.31 | 0.28 | 0.03 | 0.010 | 0.021 | −0.60 | — | — | 0.247 |
| | B12 | 0.012 | 0.57 | 0.38 | 0.03 | 0.006 | 13.5 | — | — | 0.25 | 0.05 | 0.009 | 0.021 | 3.50 | 0.20 | — | 0.220 |
| | B13 | 0.010 | 0.67 | 0.33 | 0.03 | 0.005 | 13.9 | — | 1.90 | 0.23 | 0.03 | 0.011 | 0.021 | 1.98 | 0.25 | — | 0.193 |
| | B14 | 0.009 | 0.65 | 0.35 | 0.02 | 0.003 | 16.1 | 0.07 | 3.20 | 0.31 | 0.04 | 0.010 | 0.019 | −0.30 | — | — | 0.277 |
| | B15 | 0.009 | 0.70 | 0.49 | 0.03 | 0.003 | 15.5 | 0.29 | — | 0.25 | 0.04 | 0.011 | 0.020 | 3.61 | 0.30 | — | 0.213 |
| | B16 | 0.009 | 0.68 | 0.48 | 0.02 | 0.004 | 15.1 | 0.12 | 1.96 | 0.21 | 0.03 | 0.010 | 0.019 | 1.99 | 0.10 | — | 0.188 |
| | B17 | 0.011 | 0.58 | 0.40 | 0.04 | 0.005 | 14.0 | 0.13 | 1.70 | 0.27 | 0.03 | 0.011 | 0.022 | — | — | 0.10 | 0.233 |
| | B18 | 0.013 | 0.57 | 0.50 | 0.03 | 0.006 | 14.5 | — | 1.00 | 0.35 | 0.05 | 0.009 | 0.022 | 1.01 | 0.24 | 0.07 | 0.320 |
| | B19 | 0.011 | 0.56 | 0.30 | 0.03 | 0.007 | 13.1 | 0.98 | 0.81 | 0.29 | 0.03 | 0.010 | 0.021 | 0.88 | 0.10 | 0.11 | 0.268 |
| | AISI409-1 | 0.020 | 0.30 | 0.20 | 0.02 | 0.006 | 10.9 | 0.30 | — | — | 0.02 | 0.012 | 0.032 | — | — | — | — |
| | SUS430LX-1 | 0.016 | 0.50 | 0.70 | 0.02 | 0.006 | 18.4 | — | — | 0.50 | 0.02 | 0.012 | 0.028 | — | — | — | 0.048 |

Chemical composition of sample steels; weight %
*: analytical values of misch metals

TABLE 6

| Name of steels | | Hot-rolling condition | Tensile strength at 850° C. (MPa) | Tensile strength at 850° C. after aging at 850° C. for 720 hrs. (MPa) | NaCl-induced hot corrosion thickness reduction (mm) | Normal temperature tensile breaking ductility (%) | Existence of abnormal oxidation after exposed to 900° C. for 500 hrs. in exhaust gas |
|---|---|---|---|---|---|---|---|
| | | Properties of Each Steel | | | | | |
| Steels of the invention | A9 | ○ | 35.6 | 23.5 | 0.19 | 36 | nil |
| | A10 | ○ | 36.4 | 25.0 | 0.16 | 35 | " |
| | A11 | ○ | 35.9 | 24.5 | 0.18 | 35 | " |
| | A12 | ○ | 36.5 | 24.9 | 0.15 | 35 | " |
| | A13 | ○ | 37.1 | 25.5 | 0.18 | 33 | " |
| | A14 | ○ | 37.7 | 26.0 | 0.17 | 34 | " |
| | A15 | ○ | 36.6 | 25.1 | 0.16 | 35 | " |
| | A16 | ○ | 36.6 | 25.0 | 0.15 | 34 | " |
| | A17 | ○ | 36.1 | 24.7 | 0.16 | 33 | " |
| | A18 | ○ | 37.7 | 25.2 | 0.15 | 33 | " |
| | A19 | ○ | 37.1 | 25.1 | 0.15 | 33 | " |
| Comparative steels | B9 | ○ | 39.5 | 25.5 | 0.48 | 33 | nil |
| | B10 | ○ | 37.3 | 25.7 | 0.13 | 35 | " |
| | B11 | ○ | 36.9 | 25.5 | 0.41 | 33 | yes |
| | B12 | ○ | 39.0 | 25.6 | 0.42 | 33 | nil |
| | B13 | ○ | 39.1 | 26.2 | 0.55 | 32 | " |
| | B14 | ○ | 38.0 | 26.3 | 0.40 | 33 | " |
| | B15 | ○ | 38.2 | 25.3 | 0.54 | 33 | " |
| | B16 | ○ | 39.2 | 26.3 | 0.51 | 32 | " |
| | B17 | X | — cold rolling was not possible due to occurrence of many cracks during hot rolling — | | | | |
| | B18 | Δ | 38.0 | 25.3 | 0.12 | 30 | nil |
| | B19 | X | — cold rolling was not possible due to occurrence of many cracks during hot rolling — | | | | |
| | AISI409-1 | — | 22.0 | 16.0 | 0.47 | 36 | yes |
| | SUS430LX-1 | — | 35.0 | 20.0 | 0.40 | 33 | nil |

*NaCl-induced hot corrosion: A pattern of immersion into 5% of salt water for 10 minutes, retention at 720° C. for 90 minutes and immersion into 5% of salt water for 10 minutes constituted one cycle, and the test was completed by 20 cycles.
○. . . excellent
Δ. . . testpieces could be collected, through cracks existed.
X . . . inferior It can be understood from Table 6 that SUS430LX having a low eff. Nb content had a high high-temperature strength at the initial stage but a low high-temperature strength after aging, whereas in the steels of the present invention and the comparative steels having high eff. Nb contents, the high temperature strength of at least 23 MPa could be secured even after aging at 850° C. for 720 hours, and that even when eff. Nb exceeded 0.4%, further improvement in the high temperature strength could not be expected from the comparison of A14 having the mere addition of W with B10. The comparison of A18 with B18 revealed that in the case of the composite addition of Mo and W, too, further improvements in the high temperature strength and the high temperature strength after aging could not be obtained even when eff. Nb exceeded 0.4%. In the case of B11 wherein the Zr addition amount for fixing C and N was high, the high temperature strength after aging could be secured, but its high temperature strength at the initial stage was lower than that of B9 and B14 having substantially the same W content and the eff. Nb component. Since B11 had the Si content lower than 0.5%, abnormal oxidization occurred during aging in the exhaust gas at 900° C. for 500 hours.

In connection with the NaCl-induced hot corrosion characteristics, the addition of up to about 2% improved the NaCl-induced hot corrosion resistance in the case of the addition of W or Mo alone, but as typified by B9, B11, B12, B14 and B15, an excessive addition dropped the NaCl-induced hot corrosion resistance, on the contrary. This also held true of the composite addition of Mo and W. As can be understood from the comparison of A3 and A16 with B13 and B16, the NaCl-induced hot corrosion resistance deteriorated when the Mo+W content exceeded 3.0%. As to the addition of the misch metals, the addition in an amount exceeding 0.05% allowed the occurrence of cracks during hot rolling as can be understood from the comparison of A17 to A19 with B17 to B19.

Industrial Applicability

The present invention has revealed a component system having good balance of necessary characteristics for those members which are used at a high temperature for a long time, particularly the members of an exhaust system of automobiles. Accordingly, the present invention can provide a ferrite system stainless steel which can cope with future improvements in fuel-to-cost performance, a higher output, exhaust gas purification performance, etc, of automobiles.

We claim:

1. A ferrite system stainless steel comprising, in terms of % by weight, 0.003 to 0.015 of C, up to 0.02 of N, up to 0.03 of C+N, more than 0.5 and up to 1.0 of Si, 0.1 to 1.0 of Mn, 0.01 to 0.1 of P, up to 0.01 of S, 13 to less than 17 of Cr, 0.01 to 0.5 of Ti, 0.1 to less than 0.5 of Nb, and one or two members selected from group consisting of Mo and W, with the proviso that when one member is selected, the amount is within the range of 0.1 to 2.0 and when two members are selected, the amount is within the range of 0.1 to 3.0 and the balance consisting of Fe and unavoidable impurities;

wherein, eff. Nb calculated in accordance with the following formula (1) is within the range of 0.1 to 0.4(%), and said stainless steel has a high temperature strength such that its tensile strength at 900° C. is at least 25 MPa and its tensile strength at 850° C. is at least 34 MPa, and has an excellent NaCl-induced hot corrosion resistance:

$$\text{eff. Nb}(\%) = \text{Nb}(\%) - 3 \times 93 \times fc/12 - 93 \times fn/14 \quad (1)$$

with the proviso that:

(1) when $\text{Ti}(\%) - 48 \cdot (\text{N}(\%)/2)14 > 0$,
in $\text{C}(\%) - 12 \cdot \{\text{Ti}(\%) - 48 \cdot (\text{N}(\%)/2)/14\}/48 > 0$,
$fc = \text{C}(\%) - 12 \cdot \{\text{Ti}(\%) - 48 \cdot (\text{N}(\%)/2)/14\}/48$
$fn = \text{N}(\%)/2$
in $\text{C}(\%) - 12 \cdot \{\text{Ti}(\%) - 48 \cdot (\text{N}(\%)/2)/14\}/48 \leqq 0$
$fc = 0$
$fn = \text{N}(\%)/2$
(2) when $\text{Ti}(\%) - 48 \cdot (\text{N}(\%)/2)/14 \leqq 0$,
$fc = \text{C}(\%)$
$fn = \text{N}(\%) - 14(\text{Ti}(\%)/2)/48$.

2. A ferrite system stainless steel according to claim 1, which includes, in terms of % by weight, 0.02 to 0.3 of Al in said chemical components.

3. A ferrite system stainless steel comprising, in terms of % by weight, 0.003 to 0.015 of C, not greater than 0.02 of N, not greater than 0.03 of C+N, more than 0.5 and up to 1.0 of Si, 0.1 to 1.0 of Mn, 0.01 to 0.1 of P, up to 0.01 of S, 13 to less than 17 of Cr, 0.01 to 0.5 of Zn, 0.1 to less than 0.5 of Nb, and one or two members selected from the group consisting of Mo and W, with the proviso that when one member is selected, the amount is within the range of 0.1 to 2.0 and when two members are selected, the amount is within the range or 0.1 to 3.0 and the balance consisting of Fe and unavoidable impurities;

wherein, eff. Nb calculated in accordance with the following formula (2) is within the range of 0.1 to 0.4 (%), and said stainless steel has a high temperature strength such that its tensile strength at 900° C. is at least 25 MPa and its tensile strength at 850° C. is at least 34 MPa, and has an excellent NaCl-induced hot corrosion resistance.

$$\text{eff. Nb}(\%) = \text{Nb}(\%) - 3.93 \times fc/12 - 93 \times fn/14 \quad (2)$$

with the proviso that (1) when $\text{Zr}(\%) - 91 \cdot (\text{N}(\%)/2)14 > 0$,
in $\text{C}(\%) - 12 \cdot \{\text{Ti}(\%) - 91 \cdot (\text{N}(\%)/2)/14\}/91 > 0$,
$fc = \text{c}(\%) - 12 \cdot \{\text{Zr}(\%) - 91 \cdot (\text{N}(\%)/2)/14\}/91$
$fn = \text{N}(\%)/2$
in $\text{C}(\%) - 12 \cdot \{\text{Zr}(\%) - 91 \cdot (\text{N}(\%)/2)/14\}/91 \leqq 0$
$fc = 0$
$fn = \text{N}(\%)/2$
(2) when $\text{Zr}(\%) - 91 \cdot (\text{N}(\%)/2)/14 \leqq 0$,
$fc = \text{C}(\%)$
$fn = \text{N}(\%) - 14(\text{Zr}(\%)/2)/91$.

4. A ferrite system stainless steel according to claim 3, which includes, in terms of % by weight, 0.02 to 0.3 of Al in said chemical components.

5. A ferrite system stainless steel comprising, in terms of % by weight, 0.003 to 0.015 of C, up to 0.02 of N, up to 0.03 of C+N, more than 0.5 and up to 1.0 of Si, 0.1 to 1.0 of Mn, 0.01 to 0.1 of P, up to 0.01 of S, 13 to less than 17 of Cr, 0.01 to less than 0.5 of Nb, 0.01 to 0.5 of the sum of Ti and Zr, and one or two members selected from the group consisting of Mo and W, with the proviso that when one member is selected, the amount is within the range of 0.1 to 2.0 and when the two members are selected, the amount is within the range of 0.1 to 3.0 and the balance consisting of Fe and unavoidable impurities;

wherein, eff. Nb calculated in accordance with the following formula (3) is within the range of 0.1 to 0.4 (%), and said stainless steel has a high temperature strength such that its tensile strength at 900° C. is at least 25 MPa and its tensile strength at 850° C. is at least 34 MPa, and has an excellent NaCl-induced hot corrosion resistance:

$$\text{eff. Nb}(\%) = \text{Nb}(\%) - 3.93 \times fc/12 - 93 \times fn/14 \quad (3)$$

with the proviso that:

(1) when $Ti(\%) + 48/91 \cdot Zr(\%) - 48 \cdot (N(\%) \cdot 2/3)/14 > 0$,
in $C(\%) - 12 \cdot \{Ti(\%) + 48/91 \cdot Zr(\%) - 48 \cdot (N(\%) \cdot 2/3)/14\}/48 > 0$, -continued $fc = C(\%) - 12 \cdot \{Ti(\%) + 48/91 \cdot Zr(\%) - 48 \cdot (N(\%) \cdot 2/3)/14\}/48$
$fn = N(\%)/3$
in $C(\%) - 12 \cdot \{Ti(\%) + 48/91 \cdot Zr(\%) - 48(N(\%) \cdot 2/3)/14\}/48 \leqq 0$
$fc = 0$
$fn = N(\%)/3$
(2) when $Ti(\%) + 48/91 \cdot Zr(\%) - 48 \cdot (N(\%) \cdot 2/3)14 \leqq 0$,
$fc = C(\%)$
$fn = N(\%) - 14 \cdot (Ti(\%)/2)48 - 14 \cdot (Zr(\%)/2)/91$.

6. A ferrite system stainless steel according to claim 5, which includes, in terms of % by weight, 0.02 to 0.3 of Al in said chemical components.

7. A ferrite system stainless steel according to any of claims 1, 2, 3, 4, 5 and 6 which includes, in terms of % by weight, 0.001 to 0.05, in total, of at least one element selected from the group consisting of the rare earth elements (which hereby represent the lanthanoid elements and Y) in said chemical components.

* * * * *

UNITED STATES PATENT AND TRADEMARK OFFICE

CERTIFICATE OF CORRECTION

PATENT NO. : 5,427,634

DATED : June 27, 1995

INVENTOR(S) : Nobuhiro FUJITA, et al.

It is certified that error appears in the above-indentified patent and that said Letters Patent is hereby corrected as shown below:

Column 4, line 3, change "(Nb-C)" to --(Nb•C)--.

Column 6, line 40, change "found out" to --observed--.

Column 6, line 60, after "circle" inser --o--.

Column 8, line 38, change "gets into saturation." to --reaches a saturation level.--.

Column 10, line 64, change "characterizingly" to --characteristically--.

Column 12, line 12, after "be" insert --as--.

Column 13, footnote 2 under Table 2, after "for" insert --5--.

Column 15, last line of footnote under Table 4, change "nm" to --mm--.

Column 18, row A11, under Zr, change "-0.19" to --0.19--.

Column 18, row A14, under Mo change "-0.15" to ----- and under Zr change "-" to --0.15--.

UNITED STATES PATENT AND TRADEMARK OFFICE

CERTIFICATE OF CORRECTION

PATENT NO. : 5,427,634

DATED : June 27, 1995

INVENTOR(S) : Nobuhiro FUJITA, et al.

It is certified that error appears in the above-indentified patent and that said Letters Patent is hereby corrected as shown below:

Column 18, row B10, under Mo, delete "-0.10" and insert a hyphen and under Zr delete the hyphen and insert --0.10--.

Column 18, B11, under Mo delete "-0.60" and insert a hyphen and under Zr delete the hyphen and insert --0.60--.

Column 18, row B14, under Mo delete "0.30" and insert a hyphen and under Zr delete the hyphen and insert --0.30--.

Column 20, line 29, change "or" to --of--.

Column 20, line 40, change "3.93" to --3X93--.

Column 21, line 14, change "3.93" to --3X93--.

Signed and Sealed this

Fourteenth Day of November, 1995

*Attest:*

*Attesting Officer*

Bruce Lehman

BRUCE LEHMAN

*Commissioner of Patents and Trademarks*